US009188340B2

(12) United States Patent
Bailey et al.

(10) Patent No.: US 9,188,340 B2
(45) Date of Patent: Nov. 17, 2015

(54) GAS TURBINE COMBUSTOR ENDCOVER WITH ADJUSTABLE FLOW RESTRICTOR AND RELATED METHOD

(75) Inventors: Donald Mark Bailey, Simpsonville, SC (US); Abdul Rafey Khan, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1034 days.

(21) Appl. No.: 13/300,396

(22) Filed: Nov. 18, 2011

(65) Prior Publication Data

US 2013/0125549 A1 May 23, 2013

(51) Int. Cl.

| | |
|---|---|
| ***F02C 1/00*** | (2006.01) |
| ***F23R 3/28*** | (2006.01) |
| ***F23R 3/10*** | (2006.01) |
| ***F23M 20/00*** | (2014.01) |

(52) U.S. Cl.

CPC ..... *F23R 3/28* (2013.01); *F23M 20/005* (2015.01); *F23R 3/10* (2013.01); *F23R 3/286* (2013.01); *F23R 2900/00014* (2013.01); *Y10T 29/49238* (2015.01)

(58) Field of Classification Search

CPC ..... F02C 7/22; F02C 7/222; F02C 7/232; F02C 9/26; F02C 9/266; F23R 3/286; F23R 3/002; F23R 3/04

USPC ..... 60/737, 756, 734

See application file for complete search history.

(56) References Cited

U.S. PATENT DOCUMENTS

| | | | | |
|---|---|---|---|---|
| 5,001,895 | A * | 3/1991 | Shekleton et al. | 60/804 |
| 5,235,814 | A * | 8/1993 | Leonard | 60/738 |
| 7,134,287 | B2 | 11/2006 | Belsom et al. | |
| 2005/0005610 | A1 | 1/2005 | Belsom et al. | |
| 2007/0151255 | A1 | 7/2007 | Johnson et al. | |
| 2011/0240769 | A1 * | 10/2011 | Khan et al. | 239/533.9 |

OTHER PUBLICATIONS

U.S. Appl. No. 13/008,399, filed Jan. 18, 2011 (pending).

* cited by examiner

*Primary Examiner* — Gerald L Sung
(74) *Attorney, Agent, or Firm* — Nixon & Vanderhye P.C.

(57) ABSTRACT

An endcover for a turbine combustor adapted to support one or more combustor nozzles, includes a plate having one side which in use, faces a combustion chamber and an opposite side which, in use, faces away from the combustion chamber. At least one fuel cavity is formed in the plate; and a fuel restrictor insert is formed with at least one flow orifice located within the fuel cavity for supplying fuel to at least one combustor nozzle. The fuel restrictor insert is adjustable along a length dimension of the fuel cavity.

15 Claims, 2 Drawing Sheets

GAS TURBINE COMBUSTOR ENDCOVER WITH ADJUSTABLE FLOW RESTRICTOR AND RELATED METHOD

BACKGROUND OF THE INVENTION

This invention relates to gas turbine combustors generally, and more specifically, to a novel endcover assembly for the forward or upstream end of a gas turbine combustor.

In certain gas turbines, a plurality of combustors are arranged in an annular array about the turbine rotor to provide for the combustion of fuel and guide the energized combustion products into the turbine section to drive the turbine. Each combustor typically includes an outer casing which defines the external boundary of the combustor; a flow sleeve for distributing compressor discharge air to the head end of the combustor while also cooling a liner which encloses the combustion chamber; and a transition piece for flowing the combustion products into the turbine section. The combustor also includes a plurality of fuel nozzles coupled to an endcover. Air and fuel is supplied through the endcover to the fuel nozzles for combustion within the liner. The endcover thus functions to close the combustor forward end, to support the fuel nozzles, and to distribute air and fuel to the fuel nozzles.

Endcover designs for turbine combustor systems typically have included a plate mounting each fuel nozzle individually. In prior endcover assemblies of this type, the internal passages for the air and fuel were located in the fuel nozzle, separate and apart from the endcover. A follow-on generation of endcovers provided air and fuel passages internal to the endcover. This was done to accommodate a plurality of nozzles for each endcover rather than one fuel nozzle per endcover as in prior conventional combustors. While that change simplified the fuel nozzles and enabled the mounting of a plurality of fuel nozzles onto the endcover, the complexity of the endcover was increased in order to provide the integrated air and fuel manifolds and necessary multiple passages for the fuel nozzles carried thereby. Extra parts were necessary, such as inserts, to render complex passages in the endcovers possible. Brazed joints were also included to seal these extra parts, including inserts in the endcovers. A further generation of endcovers for turbine combustors followed. These endcovers employed even more complicated brazed joints between the endcovers and their various parts. However, cracking of the brazed joints was observed on these more recent endcovers.

In addition, certain turbine model endcover assemblies formed with internal passages as noted above also require premix gas flow orifices (also referred to herein as "flow restrictors", or "flow restrictor inserts") pressed and staked into place on the "hot side" of the combustor endcover plate (that side exposed to combustion in the combustion chamber). The location of the flow restrictor within the passageway in the endcover defines the acoustic length from the fuel nozzle gas exit holes at the cold-side of the endcover to the orifice restriction proximate the hot side of the endcover. The acoustic length has a natural frequency that can be negatively impacted by combustor dynamics which vary with site conditions and fuel variation. Accordingly, there is a need to provide endcovers with orifice restrictors that can accommodate acoustic length adjustments (preferably on site), favorable to combustor dynamics.

BRIEF DESCRIPTION OF THE INVENTION

In a first exemplary embodiment, the invention provides an endcover for a turbine combustor adapted to support one or more combustor nozzles, the endcover comprising a plate having one side which in use, faces a combustion chamber and an opposite side which, in use, faces away from the combustion chamber; at least one fuel cavity in the substantially flat plate; a fuel restrictor insert formed with at least one flow orifice located within the at least one fuel cavity for supplying fuel to at least one combustor nozzle, the fuel restrictor insert adjustable along a length dimension of the at least one fuel cavity.

In another exemplary embodiment, the invention provides an endcover for a turbine combustor adapted to support one or more combustor nozzles, the endcover comprising an endcover plate having one side which in use, faces a combustion chamber and an opposite side which, in use, faces away from the combustion chamber; at least one premix fuel cavity in the endcover plate; a premix fuel supply passage in communication with said at least one premix fuel cavity; and a fuel restrictor insert formed with multiple flow orifices secured within each of the plural premix fuel cavities, the fuel restrictor insert within said at least one premix fuel cavity configured for adjustment is opposite axial directions within said at least one premix fuel cavity.

In another aspect, the invention provides a method of tuning an acoustic length property of a premix fuel cavity in an endcover of a turbine combustor adapted to support one or more combustor nozzles, wherein the endcover includes a plate having one side which in use, faces a combustion chamber and an opposite side which, in use, faces away from the combustion chamber; and a fuel restrictor insert formed with multiple flow orifices secured within the premix fuel cavity, the method comprising a) adjusting the fuel restrictor insert within the premix fuel cavity along a length dimension of the premix fuel cavity, and; b) locking the fuel restrictor insert at a predetermined location within the premix fuel cavity.

The invention will now be described in connection with the drawings identified below.

DETAILED DESCRIPTION OF THE INVENTION

Figure 1:
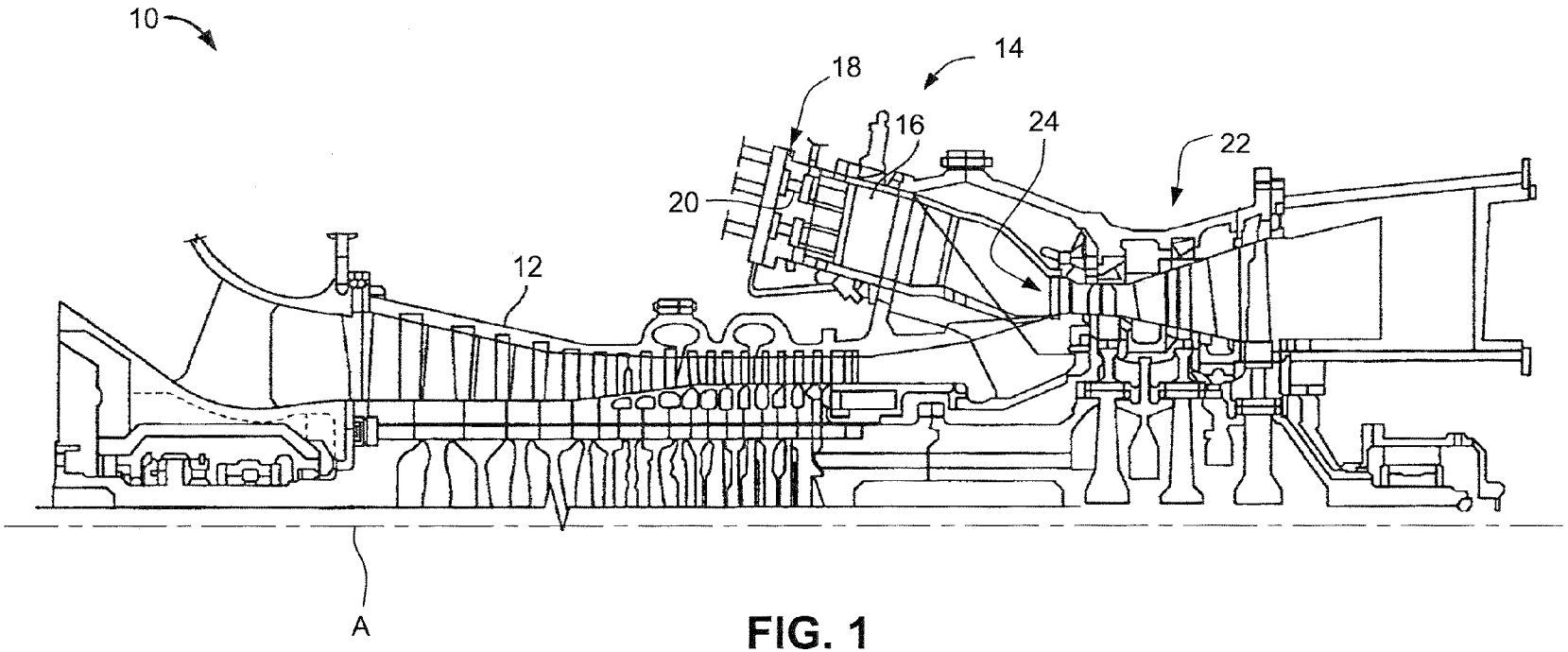
FIG. 1 (PRIOR ART)
FIG. 1 is a schematic illustration of a turbine incorporating a known combustor endcover assembly.

FIG. 1 is a schematic illustration of an exemplary gas combustion turbine engine 10. The turbine engine 10 includes a compressor 12 and a combustor 14. Combustor 14 includes a combustion region 16 and an endcover assembly 18 which supports one or more fuel (or combustor) nozzles 20. The gas turbine engine 10 also includes a turbine section 22 and a common compressor/turbine shaft (sometimes referred to as rotor) indicated by the axis A. In certain turbine engines, a plurality of combustors 14 are arranged in an annular array about the turbine rotor, all of which supply combustion gases to the turbine section first stage 24.

In operation, air flows through compressor 12 and compressed air is supplied to combustor 14. Specifically, a substantial amount of the compressed air is supplied to the endcover assembly 18 secured to the head end of the combustor 14. The fuel nozzles supported by the endcover assembly 18 channel fuel and air to combustion region 16 where the fuel/air is ignited. Combustion gases are supplied to the turbine section 20 22 where the gas stream thermal energy is converted to mechanical rotational energy.

Figure 2:
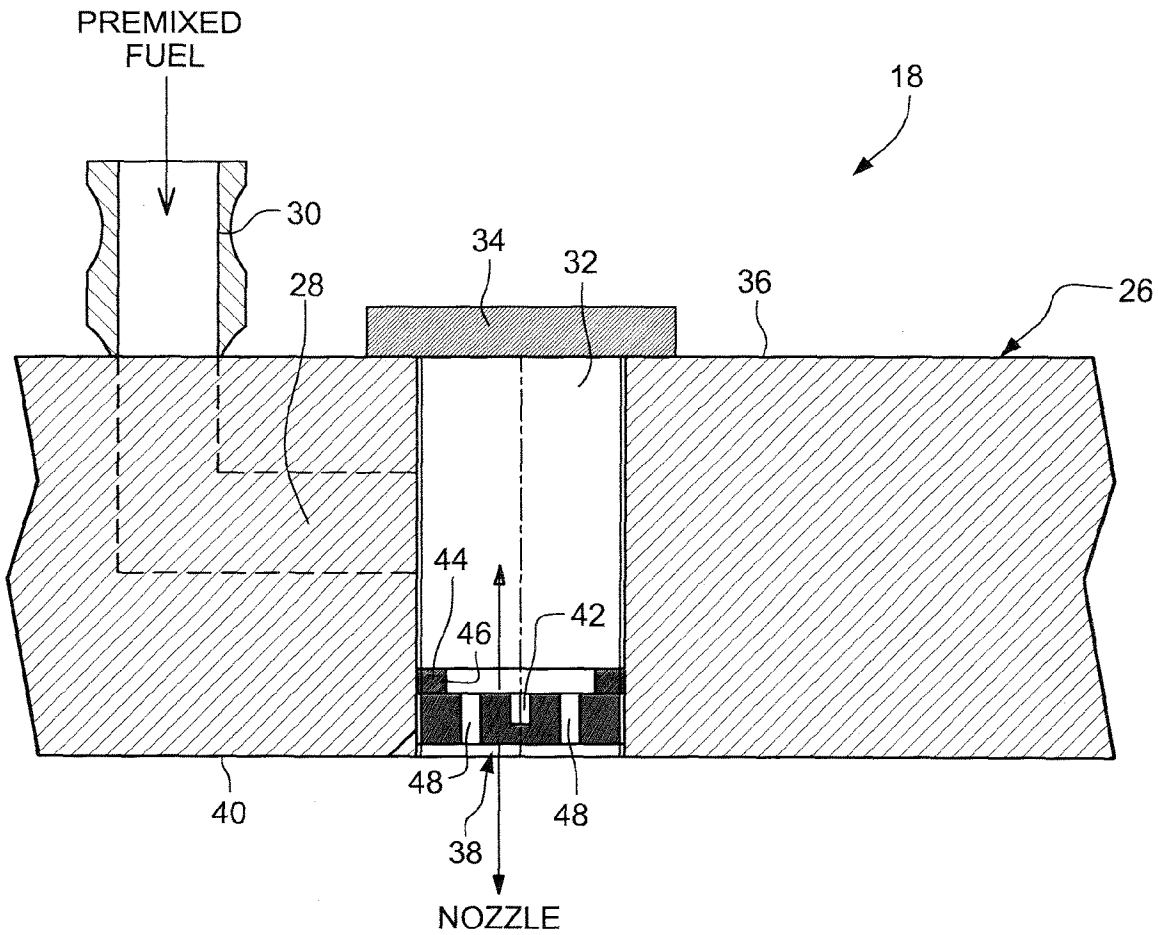
FIG. 2 is a partial section view of an endcover assembly in accordance with an exemplary but nonlimiting embodiment of the invention.

FIG. 2 illustrates an enlarged portion of the combustor endcover assembly (or simply, endcover) 18 incorporating a fuel/air flow restrictor design in accordance with an exemplary but nonlimiting embodiment of the invention. The endcover 18 is shown to include an endcover plate 26 provided with an array of holes (not shown) by which the plate is bolted to the head end of the combustor. The endcover plate 26 is also formed with internal passages (one shown at 28) through which premixed fuel is supplied to the combustor nozzles. A fuel supply connector 30 is secured to the cold side of the endcover plate 26 (i.e., that side external of, and facing away from, the combustion chamber) by any suitable means such as bolts or other fasteners. A premixed fuel supply pipe (not shown) is secured to the connector in conventional fashion. While only one internal passage 28 is shown, it will be appreciated that the number of internal passages and the size, shape and configuration of such passages are application specific. In one example, there are six internal passages supplying premixed fuel to five radially outer nozzles and a single center nozzle but many other configurations are within the scope of this invention.

The passage 28 communicates with a cavity or chamber 32 formed in the plate 26. The cavity 32 is closed at its forward or upstream end by a cover 34 on the cold side 36 of the plate. A flow restrictor insert (or flow restrictor) 38 is secured adjacent the hot side 40 of the plate 26. The flow restrictor insert 38 may also be referred to as fuel restrictor or fuel restrictor insert. The fuel restrictor or insert 38 may be made of a suitable metal material such as brass or stainless steel, with or without plating such as silver, gold or aluminum. The cavity 32 may be a bore drilled through the plate, and with at least a portion of its length threaded. The peripheral edge of the flow restrictor 38 is also threaded, thereby allowing the restrictor 38 to be adjusted toward or away from the hot and cold sides of the plate 26 via rotation of the flow restrictor. To enable such axial adjustment of the restrictor 38, an Allen key feature (e.g., a hexagonal recess) 42 may be provided on the interior side of the restrictor, so that, with the cover 34 removed, an Allen wrench may be employed to rotate and thus axially adjust the location of the flow restrictor 38 within the bore or chamber 32.

When the restrictor 38 is located as desired, a threaded lock nut 44 may be tightened against the restrictor to prevent further movement of the restrictor. Movement of the lock nut 44 may be implemented via engagement of a second tool (not shown) engageable with an inner suitably shaped surface 46 of the lock nut 44. The inner diameter of lock nut should lie radially outward of the flow restrictor orifices 48.

It will be appreciated that any suitable mechanism may be employed to rotate (i.e., apply torque to) both the insert 38 and the lock nut 44.

By "tuning" the acoustic length property of the cavity within the endcover plate, the fuel restrictor insert more effectively dampens any imbalanced fuel feed that can otherwise result in reduced air flow and reduced combustor performance.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An endcover for a turbine combustor adapted to support one or more combustor nozzles, the endcover comprising:

a plate having one side which in use, faces a combustion chamber and an opposite side which, in use, faces away from the combustion chamber;

at least one fuel cavity in said plate;

a fuel restrictor insert formed with two or more flow orifices located within said at least one fuel cavity for supplying fuel to at least one combustor nozzle, said fuel restrictor insert adjustable along a length dimension of said at least one fuel cavity.

2. The endcover of claim 1 wherein said fuel cavity is internally at least partially threaded, and said fuel restrictor insert is externally threaded, thereby permitting axial movement of said fuel restrictor insert along said fuel cavity via rotation of said fuel restrictor insert.

3. The endcover of claim 2 wherein a lock-nut is threadably received within said fuel cavity on an upstream side of said fuel restrictor insert.

4. The endcover of claim 2 wherein said at least one flow orifice comprises multiple flow orifices and wherein said lock-nut is formed with a center opening having a diameter lying radially outward of said multiple flow orifices.

5. The endcover of claim 1 wherein a cover plate is removably attached to said opposite side of said plate, closing said fuel cavity at said opposite side.

6. The endcover of claim 5 wherein a fuel feed passageway communicates with said fuel cavity downstream of said cover plate and upstream of said at least one fuel restrictor insert.

7. The endcover of claim 1 wherein said fuel restrictor insert is constructed of a plated-metal material.

8. The endcover of claim 4 wherein said center opening is shaped for engagement with a torque application tool.

9. An endcover for a turbine combustor adapted to support one or more combustor nozzles, the endcover comprising:

an endcover plate having one side which in use, faces a combustion chamber and an opposite side which, in use, faces away from the combustion chamber; at least one premix fuel cavity in said endcover plate;

a premix fuel supply passage in communication with said at least one premix fuel cavity; and a fuel restrictor insert formed with multiple flow orifices secured within said at least one premix fuel cavity, said fuel restrictor insert configured for adjustment in opposite axial directions within said at least one premix fuel cavity.

10. The endcover of claim 9 wherein said at least one premix fuel cavity is internally at least partially threaded, and said fuel restrictor insert is externally threaded, thereby permitting the adjustment of said fuel restrictor insert along said at least one premix fuel cavity via rotation of said fuel restrictor insert.

11. The endcover of claim 10 wherein a lock-nut is threadably received said at least one premix fuel cavity on an upstream side of said fuel restrictor insert for locking said fuel restrictor insert in a predetermined position.

12. The endcover of claim 11 wherein said lock-nut is formed with a center opening having a diameter lying outside said multiple flow orifices.

13. The endcover of claim 9 wherein said fuel restrictor insert is provided with a blind recess on an upstream side thereof adapted to receive a tool for rotating said fuel restrictor insert.

14. The endcover of claim 9 wherein cover plates are removably attached to said opposite side of said plate, closing said at least one premix fuel cavity at said opposite side.

15. The endcover of claim 14 wherein one or more fuel feed passageways communicates with said at least one plural pre-mix fuel cavity downstream of said cover plate.

* * * * *